US009297107B2

(12) United States Patent
Jenkins

(10) Patent No.: US 9,297,107 B2
(45) Date of Patent: Mar. 29, 2016

(54) CLEANING METHOD

(75) Inventor: Stephen Derek Jenkins, Cleveland (GB)

(73) Assignee: Xeros Limited, Rotherham (GB)

( * ) Notice: Subject to any disclaimer, the term of this patent is extended or adjusted under 35 U.S.C. 154(b) by 608 days.

(21) Appl. No.: 13/640,346

(22) PCT Filed: Apr. 12, 2011

(86) PCT No.: PCT/GB2011/050725

§ 371 (c)(1),
(2), (4) Date: Oct. 10, 2012

(87) PCT Pub. No.: WO2011/128680

PCT Pub. Date: Oct. 20, 2011

(65) Prior Publication Data

US 2013/0061404 A1 Mar. 14, 2013

(30) Foreign Application Priority Data

Apr. 12, 2010 (GB) ..... 1006076.2
Jun. 24, 2010 (GB) ..... 1010591.4

(51) Int. Cl.
*C11D 1/00* (2006.01)
*C11D 3/37* (2006.01)
(Continued)

(52) U.S. Cl.
CPC ..... *D06F 39/024* (2013.01); *B08B 3/04* (2013.01); *C11D 3/3715* (2013.01);
(Continued)

(58) Field of Classification Search
CPC ..... C11D 1/00; C11D 3/37; C11D 3/3715; C11D 3/3719; C11D 3/3726; C11D 3/386; C11D 3/395; C11D 11/0005; D06L 1/16; D06L 1/20; B08B 3/04; B08B 3/14
See application file for complete search history.

(56) References Cited

U.S. PATENT DOCUMENTS 2,970,464 A 2/1961 Toma
3,321,843 A 5/1967 Taran et al.
(Continued)

FOREIGN PATENT DOCUMENTS

CA 1284407 C 5/1991
CA 2147207 A 5/1994
(Continued)

OTHER PUBLICATIONS

U.S. Appl. No. 14/427,046, Xeros Ltd.
(Continued)

*Primary Examiner* — Brian P Mruk
(74) *Attorney, Agent, or Firm* — Clark & Elbing LLP

(57) ABSTRACT

The invention provides a method for cleaning a soiled substrate, the method comprising the treatment of the moistened substrate with a formulation comprising a multiplicity of polymeric particles, wherein the polymeric particles are applied in combination with a detergent formulation, the method being characterized in that the detergent formulation is divided into its separate chemical constituents and these chemical constituents are added at different times during the wash cycle. The method allows for improved cleaning with reduced overall chemical loading, and facilitates addition of the more expensive parts of the formulations when they are most effective for cleaning performance, thereby providing considerable cost savings in comparison with conventional all-in-one detergent formulations. A method for cleaning the polymeric particles is also provided.

16 Claims, 4 Drawing Sheets

(51) Int. Cl.

| | |
|---|---|
| ***C11D 3/386*** | (2006.01) |
| ***C11D 3/395*** | (2006.01) |
| ***D06L 1/16*** | (2006.01) |
| ***D06L 1/20*** | (2006.01) |
| ***B08B 3/04*** | (2006.01) |
| ***B08B 3/14*** | (2006.01) |
| ***D06F 39/02*** | (2006.01) |
| ***C11D 11/00*** | (2006.01) |
| ***C11D 17/04*** | (2006.01) |

(52) U.S. Cl.

CPC ..... *C11D 3/3719* (2013.01); *C11D 11/0017* (2013.01); *C11D 11/0035* (2013.01); *C11D 17/041* (2013.01); *D06F 39/022* (2013.01); *D06L 1/16* (2013.01); *D06L 1/20* (2013.01)

(56) References Cited

U.S. PATENT DOCUMENTS

| | | | |
|---|---|---|---|
| 3,333,344 | A | 8/1967 | Loewen |
| 3,647,354 | A | 3/1972 | Loeb |
| 3,650,673 | A | 3/1972 | Ehner |
| 3,805,406 | A | 4/1974 | Castonoli |
| 4,055,248 | A | 10/1977 | Marsan |
| 4,130,392 | A | 12/1978 | Diehl et al. |
| 4,188,807 | A | 2/1980 | Brodzina et al. |
| 4,374,443 | A | 2/1983 | Mosell |
| 4,434,067 | A | 2/1984 | Malone et al. |
| 4,493,783 | A | 1/1985 | Su et al. |
| 4,575,887 | A | 3/1986 | Viramontes |
| 4,655,952 | A | 4/1987 | Mesmer et al. |
| 4,750,227 | A | 6/1988 | Hopkins et al. |
| 4,801,333 | A | 1/1989 | Mosell |
| 4,809,854 | A | 3/1989 | Tomaszek |
| 4,839,969 | A | 6/1989 | Hahn |
| 4,951,366 | A | 8/1990 | Geller |
| 4,978,619 | A | 12/1990 | Kajiwara et al. |
| 5,245,722 | A | 9/1993 | Dameron |
| 5,305,533 | A | 4/1994 | Alexander et al. |
| 5,468,175 | A | 11/1995 | Nilen |
| 5,475,992 | A | 12/1995 | Wiegert |
| 5,503,840 | A | 4/1996 | Jacobson et al. |
| 5,547,476 | A | 8/1996 | Siklosi et al. |
| 5,601,480 | A | 2/1997 | Nilen |
| 5,605,491 | A | 2/1997 | Yam et al. |
| 5,667,431 | A | 9/1997 | Mortin |
| 5,804,548 | A | 9/1998 | Davis |
| 5,925,195 | A | 7/1999 | King et al. |
| 5,980,620 | A | 11/1999 | Brodie et al. |
| 5,993,839 | A | 11/1999 | Mixon |
| 6,235,705 | B1 | 5/2001 | Zembrodt et al. |
| 6,348,441 | B1 | 2/2002 | Aiken, III et al. |
| 6,376,046 | B1 | 4/2002 | Hoshino et al. |
| 6,448,212 | B1 | 9/2002 | Holderbaum et al. |
| 7,070,489 | B2 | 7/2006 | Rogmark |
| 7,097,715 | B1 | 8/2006 | Racette et al. |
| 7,481,893 | B2 | 1/2009 | Motson et al. |
| 7,498,294 | B2 | 3/2009 | Konno et al. |
| 8,974,545 | B2 | 3/2015 | Burkinshaw et al. |
| 9,017,423 | B2 | 4/2015 | Burkinshaw et al. |
| 9,121,000 | B2 | 9/2015 | Burkinshaw et al. |
| 9,127,882 | B2 | 9/2015 | Jenkins et al. |
| 2002/0010300 | A1 | 1/2002 | Mimoun |
| 2002/0016282 | A1 | 2/2002 | Kumar et al. |
| 2002/0039976 | A1 | 4/2002 | Sebillotte-Arnaud et al. |
| 2002/0058595 | A1 | 5/2002 | Kaiser |
| 2003/0110580 | A1 | 6/2003 | Burkinshaw et al. |
| 2003/0134759 | A1 | 7/2003 | Geary et al. |
| 2004/0171515 | A1 | 9/2004 | Hamers et al. |
| 2004/0266641 | A1 | 12/2004 | Gentschev et al. |
| 2005/0148479 | A1 | 7/2005 | Barthel et al. |
| 2005/0153865 | A1 | 7/2005 | Detering et al. |
| 2005/0183206 | A1 | 8/2005 | Brown et al. |
| 2005/0183208 | A1 | 8/2005 | Scheper et al. |
| 2005/0204477 | A1 | 9/2005 | Casella et al. |
| 2006/0287212 | A1 | 12/2006 | Sommer et al. |
| 2007/0151312 | A1 | 7/2007 | Bruce et al. |
| 2007/0270327 | A1 | 11/2007 | Beck et al. |
| 2008/0090746 | A1 | 4/2008 | Penninger |
| 2008/0223406 | A1 | 9/2008 | Lindqvist et al. |
| 2008/0276965 | A1 | 11/2008 | Aykroyd et al. |
| 2008/0306183 | A1 | 12/2008 | Leukel et al. |
| 2009/0090138 | A1 | 4/2009 | Wang |
| 2009/0186795 | A1 | 7/2009 | Feenstra et al. |
| 2009/0217461 | A1 | 9/2009 | Burkinshaw et al. |
| 2010/0281928 | A1 | 11/2010 | Martin |
| 2011/0296628 | A1 | 12/2011 | Jenkins et al. |
| 2012/0048299 | A1 | 3/2012 | Jenkins et al. |
| 2012/0111359 | A1 | 5/2012 | Mueller et al. |
| 2012/0284931 | A1 | 11/2012 | Jenkins et al. |
| 2012/0304400 | A1 | 12/2012 | Jenkins et al. |
| 2013/0167882 | A1 | 7/2013 | Burkinshaw et al. |
| 2013/0276242 | A1 | 10/2013 | Jenkins et al. |
| 2013/0281345 | A1 | 10/2013 | Burkinshaw et al. |
| 2013/0283542 | A1 | 10/2013 | Jenkins et al. |
| 2013/0305560 | A1 | 11/2013 | Jenkins et al. |
| 2014/0137340 | A1 | 5/2014 | Burkinshaw et al. |
| 2015/0096128 | A1 | 4/2015 | Sawford et al. |
| 2015/0096129 | A1 | 4/2015 | Sawford et al. |
| 2015/0128358 | A1 | 5/2015 | Wells et al. |
| 2015/0148278 | A1 | 5/2015 | Burkinshaw et al. |
| 2015/0152357 | A1 | 6/2015 | Abercrombie et al. |
| 2015/0152585 | A1 | 6/2015 | Sawford et al. |
| 2015/0175945 | A1 | 6/2015 | Waddon et al. |
| 2015/0344824 | A1 | 12/2015 | Burkinshaw et al. |

FOREIGN PATENT DOCUMENTS

| | | | |
|---|---|---|---|
| CN | 1244778 | A | 2/2000 |
| CN | 1440450 | A | 9/2003 |
| CN | 1723008 | A | 1/2006 |
| CN | 2789299 | Y | 6/2006 |
| CN | 101006108 | A | 7/2007 |
| CN | 101302700 | A | 11/2008 |
| CN | 101886321 | A | 11/2010 |
| CN | 202500017 | U | 10/2012 |
| DE | 1900002 | A1 | 7/1970 |
| DE | 2819233 | A1 | 11/1979 |
| DE | 19505921 | A1 | 8/1996 |
| DE | 10247289 | A1 | 4/2004 |
| DE | 102008009462 | A1 | 8/2009 |
| DE | 102009046170 | | 5/2011 |
| EP | 0090372 | A1 | 10/1983 |
| EP | 0171215 | A1 | 2/1986 |
| EP | 0312278 | A2 | 4/1989 |
| EP | 0807463 | A2 | 11/1997 |
| EP | 1371718 | A1 | 12/2003 |
| FR | 2525645 | A1 | 10/1983 |
| FR | 2826548 | A1 | 1/2003 |
| GB | 1018318.4 | | 1/1966 |
| GB | 920791 | A | 3/1968 |
| GB | 1 256 064 | | 12/1971 |
| GB | 1297316 | A | 11/1972 |
| GB | 1379742 | A | 1/1975 |
| GB | 2249104 | A | 4/1992 |
| GB | 2302553 | A | 1/1997 |
| GB | 2365648 | A | 2/2002 |
| GB | 2456407 | A | 7/2009 |
| JP | S59-48078 | A | 3/1984 |
| JP | S59-196758 | A | 11/1984 |
| JP | H01-132697 | A | 5/1989 |
| JP | H0128588 | A | 11/1989 |
| JP | H0257295 | A | 2/1990 |
| JP | H03-146094 | B2 | 6/1991 |
| JP | 4105633 | | 4/1992 |
| JP | H04241165 | A | 8/1992 |
| JP | H06240297 | A | 8/1994 |
| JP | 2004-167345 | A | 6/2004 |
| JP | 2004238602 | A | 8/2004 |
| JP | 2006-326434 | A | 12/2006 |
| TW | 231275 | B | 10/1994 |
| WO | WO-98/37270 | A1 | 8/1998 |
| WO | WO-99/40251 | A1 | 8/1999 |

(56) References Cited

FOREIGN PATENT DOCUMENTS

| | | | | | |
|---|---|---|---|---|---|
| WO | WO-00/37540 | A1 | | 6/2000 | |
| WO | WO-00/77153 | A1 | | 12/2000 | |
| WO | WO-02/42403 | A1 | | 5/2002 | |
| WO | WO-03/054128 | A1 | | 7/2003 | |
| WO | WO-2004/066970 | A1 | | 8/2004 | |
| WO | WO-2006/020789 | A1 | | 2/2006 | |
| WO | WO-2006/040539 | A1 | | 4/2006 | |
| WO | WO-2007/070520 | A1 | | 6/2007 | |
| WO | WO 2007/128962 | | * | 11/2007 | ..... B08B 3/10 |
| WO | WO2007128962 | | | 11/2007 | |
| WO | WO-2008/132456 | A1 | | 11/2008 | |
| WO | WO-2009/021919 | A2 | | 2/2009 | |
| WO | WO-2009/112296 | A1 | | 9/2009 | |
| WO | WO-2009/134018 | A2 | | 11/2009 | |
| WO | WO-2010/046473 | A1 | | 4/2010 | |
| WO | WO-2010/094959 | A1 | | 8/2010 | |
| WO | WO-2010/133837 | A1 | | 11/2010 | |
| WO | WO-2010/139689 | A1 | | 12/2010 | |
| WO | WO-2011/015429 | A2 | | 2/2011 | |
| WO | WO-2011/051140 | A1 | | 5/2011 | |
| WO | WO-2011/064581 | A1 | | 6/2011 | |
| WO | WO-2011/098815 | A1 | | 8/2011 | |
| WO | WO-2011/128676 | A1 | | 10/2011 | |
| WO | WO-2012/056252 | A2 | | 5/2012 | |
| WO | WO-2012/084619 | A1 | | 6/2012 | |
| WO | WO-2012/104861 | A1 | | 8/2012 | |
| WO | WO-2014/037729 | A1 | | 3/2014 | |

OTHER PUBLICATIONS

U.S. Appl. No. 14/588,500, Xeros Ltd.

U.S. Appl. No. 14/588,510, Xeros Ltd.

"Aqua Ball Set", <http://www.auravita.com/products/AURA/TAPR10610.asp>, retrieved on Aug. 14, 2006 (3 pages).

"Capture Carpet Cleaning Kit", <http://www.basichomeshopping.com/CaptureCarpetCleanerKit.html>, retrieved on Aug. 11, 2005 (4 pages).

"Capture Carpet Cleaning Kit", <http://www.domesticsale.com/Classifieds/15175.html>, retrieved on Aug. 11, 2005 (1 page).

International Search Report for International Application No. PCT/GB2011/050725, dated Nov. 21, 2011 (6 pages).

Michalon et al., "Enzyme coupling method on calibrated nylon spheres: application to the selective trypsinization of histones in chromatin," Biochem Biophys Res Commun. 167(1):9-15 (1990).

Migneault et al., "Glutaraldehyde: behavior in aqueous solution, reaction with proteins, and application to enzyme crosslinking," Biotechniques. 37(5):790-802 (2004).

Silva et al., "Laccase immobilization on enzymatically functionalized polyamide 6,6 fibres," Enzyme Microb Technol. 41:867-75 (2007).

Talbert et al., "Chitosan-tethered microspheres for lactase immobilization," J Mol Catal B Enzym. 78:78-84 (2012).

Written Opinion for the International Application PCT/GB2011/050725, dated Nov. 21, 2011 (9 pages).

* cited by examiner

FIGURE 2 - STAIN MONITOR STAIN STRENGTH - BACKGROUND WHITENESS
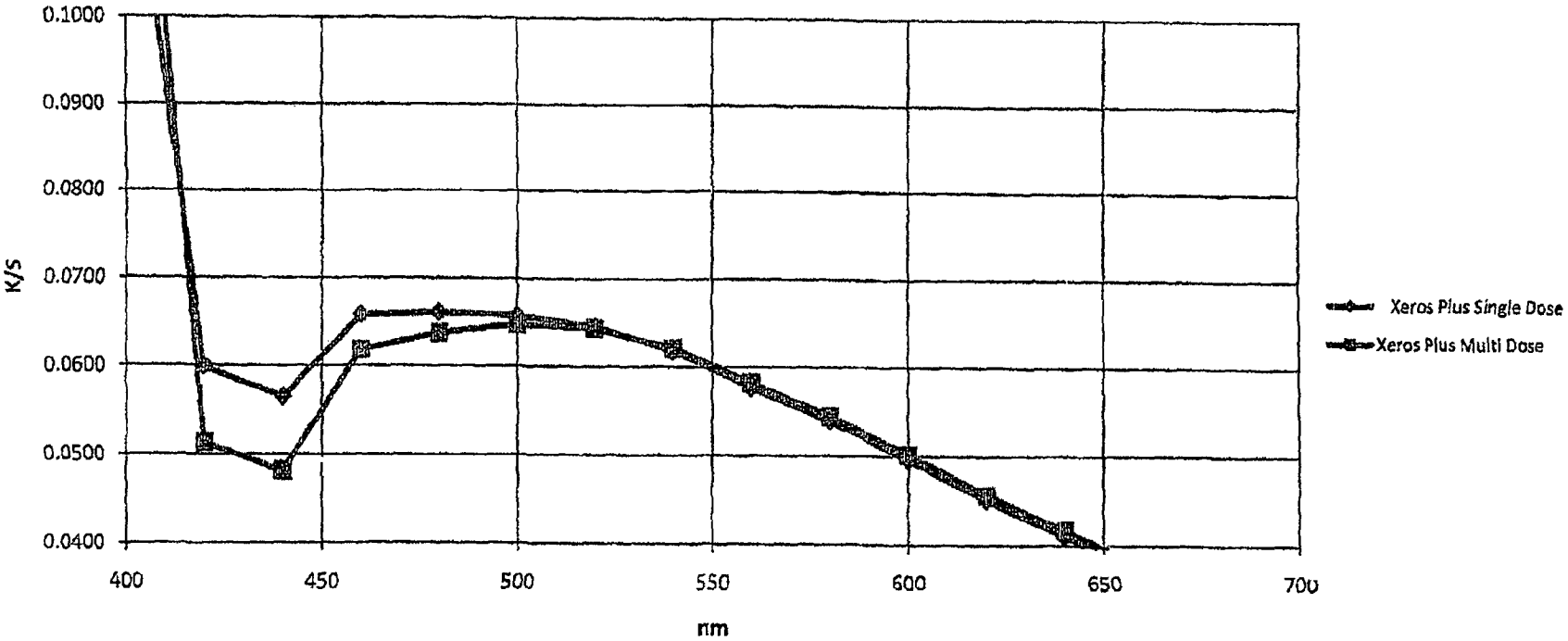

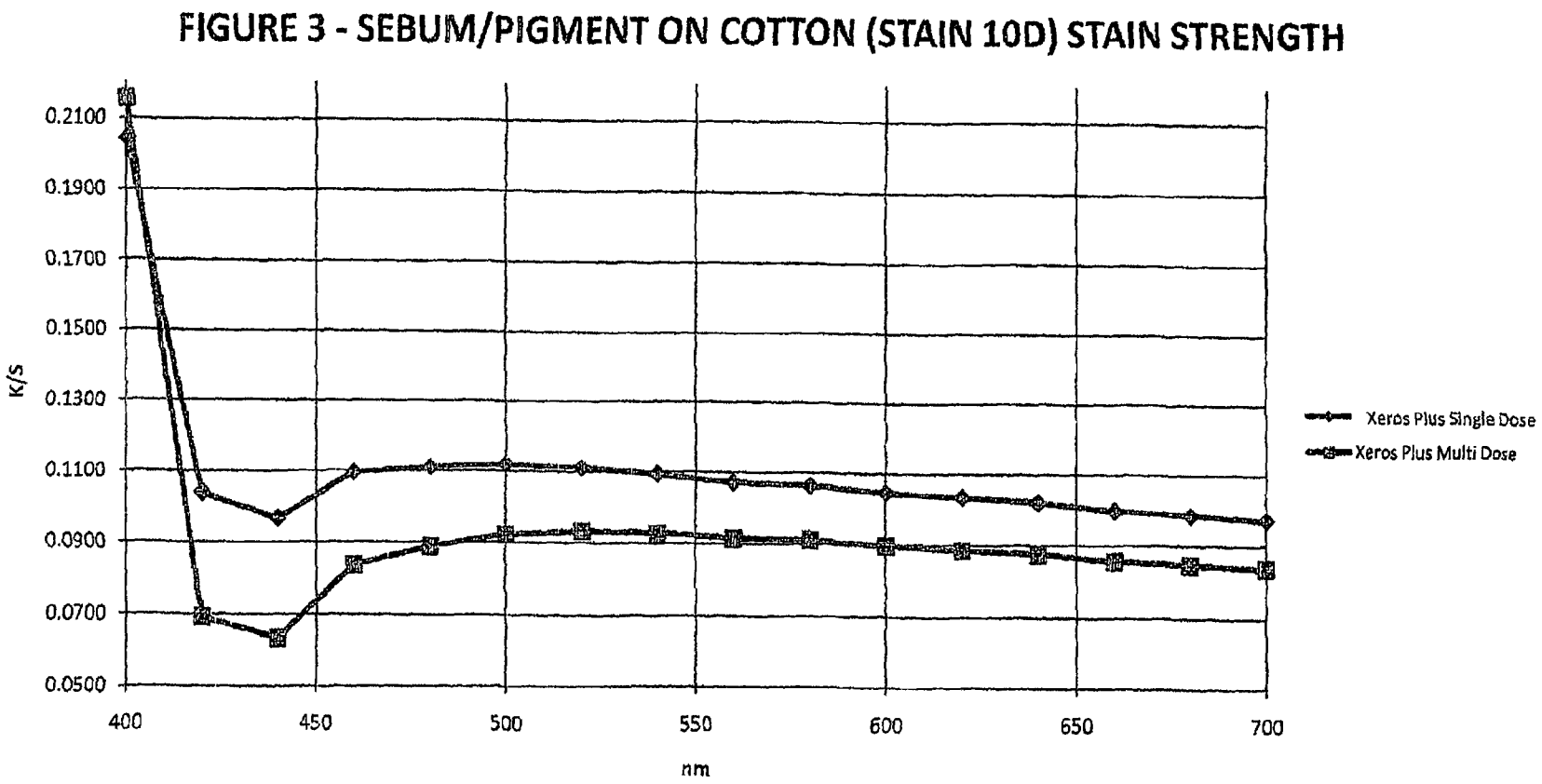
FIGURE 3 - SEBUM/PIGMENT ON COTTON (STAIN 10D) STAIN STRENGTH
Xeros Plus Single Dose
Xeros Plus Multi Dose
K/S
0.2100
0.1900
0.1700
0.1500
0.1300
0.1100
0.0900
0.0700
0.0500
400
450
500
550
600
650
700
nm

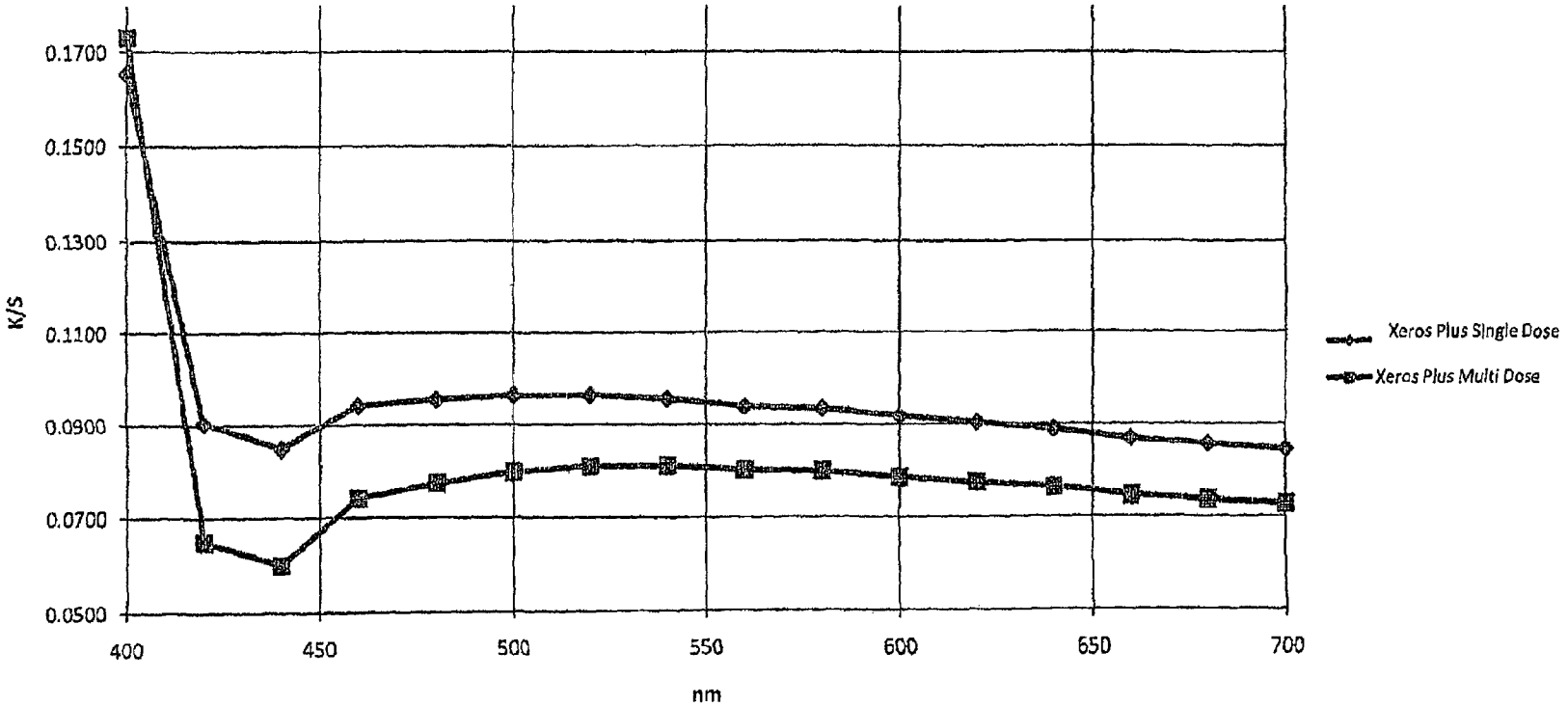
FIGURE 4 - SEBUM/PIGMENT ON POLYESTER/COTTON (STAIN 20D) STAIN STRENGTH

CLEANING METHOD

CROSS-REFERENCE TO RELATED APPLICATIONS

This application is filed under the provisions of 35 U.S.C. §371 and claims the priority of International Patent Application No. PCT/GB2011/050725 filed on Apr. 12, 2011 which in turn claims priority of Great Britain Application Nos. 1006076.2 filed on Apr. 12, 2010 and 1010591.4 filed on Jun. 24, 2010, the contents of which are incorporated by reference herein for all purposes.

FIELD OF THE INVENTION

This invention relates to the treatment of substrates. More specifically, the invention is concerned with a method for the cleaning of substrates which involves the use of a cleaning treatment based on polymeric particles in which detergents are added to the cleaning system by means of a novel dosing process wherein the detergents are split into their constituent chemical parts which are added at different times during the wash cycle.

BACKGROUND TO THE INVENTION

Traditional wet cleaning is a process of major importance for textiles which routinely relies on the washing action provided by relatively large quantities of water, in combination with appropriate detergent formulations. These formulations are extremely complex in their make up, but typically comprise a combination of surfactants, with or without a series of enzymes to provide a biological action in the removal of certain stains, together with oxidising or bleaching components with their associated activators to neutralise highly coloured stains. In addition, the formulations typically include builders to control water hardness, anti-redposition additives to prevent resettling of removed stain back on to the textile surface, perfumes to ensure the expected level of fragrancy, and optical brighteners to further mask the effects of redeposition—particularly on white garments.

In conventional wet cleaning processes, the detergent formulation is usually added as an all-in-one dosing, or there may be a pre-wash and main wash split where a softener or other formulated additive is used separately. The problem that arises, however, is that there is a significant dilution of certain chemical parts in the detergent formulation at the textile surface as the wash progresses, with the consequence that good cleaning occurs at the expense of anti-redeposition additives, perfumes and optical brighteners being removed from the cleaned textile. These three parts of the detergent formulation, most particularly, are instrumental in meeting consumer needs when cleaning quality is judged. Hence, in conventional wet cleaning processes, all-in-one detergent formulations are effectively overloaded with these chemicals, in order to ensure that they remain present in sufficient quantities on the final cleaned textile surface. Naturally, this procedure increases the overall chemical loading in the wash process and, of course, the cost of the detergent formulation itself.

In the method disclosed in WO-A-2007/128962, the cleaning process employs a cleaning formulation which is essentially free of organic solvents and requires the use of only limited amounts of water, thereby offering significant environmental benefits. Thus, the inventors disclose a method for cleaning a soiled substrate, the method comprising the treatment of the moistened substrate with a formulation comprising a multiplicity of polymeric particles, wherein the formulation is free of organic solvents.

However, whilst this method provides significant advantages over the prior art, problems may arise as a consequence of interactions between detergent formulations which are employed in the process and the polymer particles. Thus, it is found that premature removal of some of the formulation components by the polymeric particles can result in poorer cleaning and redeposition performance than could otherwise be achieved. It is these issues that the present invention seeks to address.

Whilst the method of WO-A-2007/128962 typically employs very similar detergent formulations to traditional wet cleaning processes, the concept of high chemical loading in order to deal with the kind of inadequate cleaning and re-deposition problems which may arise is not a realistic option, either practically or economically. Consequently, the present inventors have now devised a modified process which addresses these difficulties by providing a detergent dosing process which splits the formulation into its constituent chemical parts, these being added at different times during the wash cycle. In this way, not only is the overall chemical loading reduced, but the more expensive parts of the formulations may be added when they are likely to be most effective for cleaning performance. As a consequence, considerable cost savings may be achieved when compared with conventional all-in-one detergent formulations.

SUMMARY OF THE INVENTION

Thus, according to a first aspect of the present invention, there is provided a method for cleaning a soiled substrate, said method comprising the treatment of the moistened substrate with a formulation comprising a multiplicity of polymeric particles, wherein said polymeric particles are applied in combination with a detergent formulation, characterised in that said detergent formulation is divided into its separate chemical constituents and said chemical constituents are added at different times during the wash cycle.

Specifically, it is required that the cleaning parts of the formulation are added before or during the main wash cycle in order to provide the degree of stain removal required, whilst the remaining, more expensive—and hence more value adding—parts of the formulation are added as a post-treatment, following removal of the polymeric particles from the wash process. Typically, the cleaning components comprise surfactants, enzymes and oxidising agents or bleaches, whilst the post-treatment components include, for example, anti-redeposition additives, perfumes and optical brighteners.

The substrate cleaned by the claimed method may comprise any of a wide range of substrates, including, for example, plastics materials, leather, paper, cardboard, metal, glass or wood. In practice, however, said substrate most preferably comprises a textile fibre, which may be either a natural fibre, such as cotton, or a synthetic textile fibre, for example nylon 6,6 or a polyester.

Said polymeric particles may comprise any of a wide range of different polymers. Specifically, there may be mentioned polyalkenes such as polyethylene and polypropylene, polyesters and polyurethanes, which may be linear or crosslinked and foamed or unfoamed. Preferably, however, said polymeric particles comprise polyamide or polyester particles, most particularly particles of nylon, polyethylene terephthalate or polybutylene terephthalate, most preferably in the form of beads. Said polyamides and polyesters are found to be particularly effective for aqueous stain/soil removal, whilst polyalkenes are especially useful for the removal of oil-based stains. Optionally, copolymers of the above polymeric materials may be employed for the purposes of the invention.

Various nylon or polyester homo- or co-polymers may be used including, but not limited to, Nylon 6, Nylon 6,6, polyethylene terephthalate and polybutylene terephthalate. Preferably, the nylon comprises Nylon 6,6 homopolymer having a molecular weight in the region of from 5000 to 30000 Daltons, preferably from 10000 to 20000 Daltons, most preferably from 15000 to 16000 Daltons. The polyester will typically have a molecular weight corresponding to an intrinsic viscosity measurement in the range of from 0.3-1.5 dl/g, as measured by a solution technique such as ASTM D-4603.

The polymeric particles are of such a shape and size as to allow for good flowability and intimate contact with the textile fibre. A variety of shapes of particles can be used, such as cylindrical, spherical or cuboid; appropriate cross-sectional shapes can be employed including, for example, annular ring, dog-bone and circular. The particles may have smooth or irregular surface structures and can be of solid or hollow construction. Particles are preferably of such a size as to have an average mass in the region of 5 to 500 mg, preferably from 10 to 100 mg, most preferably from 10 to 30 mg. In the case of cylindrical beads, the preferred particle diameter is in the region of from 1.0 to 6.0 mm, more preferably from 1.5 to 4.0 mm, most preferably from 2.0 to 3.0 mm, and the length of the beads is preferably in the range from 1.0 to 4.0 mm, more preferably from 1.5 to 3.5 mm, and is most preferably in the region of 2.0 to 3.0 mm.

Typically, for spherical beads, the preferred diameter of the sphere is in the region of from 1.0 to 6.0 mm, more preferably from 2.0 to 4.5 mm, most preferably from 2.5 to 3.5 mm.

The method of the invention may be applied to a wide variety of substrates as previously stated. More specifically, it is applicable across the range of natural and synthetic textile fibres, but it finds particular application in respect of nylon 6,6, polyester and cotton fabrics.

In order to provide additional lubrication to the cleaning system, and thereby improve the transport properties within the system, water is added to the system. Thus, following their addition to the system, more efficient transfer of the cleaning parts of the detergent formulation (typically surfactants, enzymes and oxidising agents or bleaches) to the substrate is facilitated, and removal of soiling and stains from the substrate occurs more readily. Optionally, the soiled substrate may be moistened by wetting with mains or tap water prior to loading into the cleaning apparatus. In any event, water is added to the process such that the washing treatment is carried out so as to achieve a water to substrate ratio which is preferably between 2.5:1 and 0.1:1 w/w; more preferably, the ratio is between 2.0:1 and 0.8:1, with particularly favourable results having been achieved at ratios such as 1.5:1, 1.2:1 and 1.1:1.

The post-treatment components in the detergent formulation, which typically comprise anti-redeposition additives, perfumes and optical brighteners, are added after removal of the polymeric particles from the wash process, as part of the rinse cycle. This facilitates their direct interaction with the substrate at lower concentrations than if they were routinely added via all-in-one detergent dosing. Hence, there is both an overall reduction in the chemical loading, as well as a cost saving, generated by this dosing approach. Furthermore, improved cleaning performance is also observed.

In addition, use of the claimed multi-component dosing system offers wider scope in the use of cleaning chemicals since, in conventional cleaning product formulations, the selection of cleaning components may be limited due to incompatibility and stability of the resulting formulation as, for example, with the use of oxidising components in combination with enzymes, or the potential interaction of perfume components with chlorine-based bleaches. In the former case, cleaning may be adversely affected by killing the enzyme too early in the process with the oxidising agent, whilst, in the latter instance, the perfume may become overpowered by the smell of bleach. By adopting the separate addition of these components, such difficulties are avoided.

In a specific embodiment, the possibility of pre-heating the oxidising or bleaching component of the formulation separately from the main wash, for example in a mixing tank, is facilitated, thereby allowing this component to become more active chemically prior to addition to the wash system. As the amount of water required for this pre-mixing can be low, there is little power consumed in such heating, and hence highly active oxidising or bleaching chemistry can be added with little penalty in terms of power usage and, hence, cost. This could provide further benefits therefore, either through reduced main wash cycle time or reduced power consumption, whilst maintaining parity cleaning when compared with single dose processes wherein there would be a requirement to heat the entire washload to equal chemical activation of the oxidising or bleaching chemistry, which would be a slow and costly process by comparison.

In an alternative embodiment of the present invention, the oxidising or bleaching component may be activated by means of a chemical activation agent, which may conveniently be incorporated in the detergent formulation.

The method of the first aspect of the present invention may be used for either small or large scale processes of both the batchwise and continuous variety and, therefore, finds application in both domestic and industrial cleaning processes.

The invention also envisages the cleaning of used polymeric particles according to the multi-component dosing approach previously disclosed, so that an apparatus comprising a cleaning chamber and at least one dosing compartment, said at least one compartment being adapted to contain at least one component of the detergent formulation may be utilised for this purpose. Suitable apparatus is disclosed in, for example, PCT Patent Applications Nos. PCT/GB2011/050243, PCT/GB2010/051960 and PCT/GB2010/094959. Following a number of cleaning cycles (typically 10 to 12) the polymeric cleaning particles can become soiled, but may be cleaned and re-cycled in order to facilitate their re-use, which clearly offers significant economic advantages. Thus, according to a third aspect of the present invention, there is provided a method for cleaning soiled polymeric particles, said method comprising treating said polymeric particles with a detergent formulation. Optionally, said detergent formulation is divided into its separate chemical constituents for addition of said chemical constituents at different times during the cleaning process. Preferably, said method is carried out using the apparatus above.

BRIEF DESCRIPTION OF THE DRAWINGS

Embodiments of the invention are further described hereinafter with reference to the accompanying drawing, wherein:

FIG. 2 shows a comparison of the cleaning performance of single and multi-dosing cleaning methods in terms of background whiteness of the stained samples.

FIG. 3 shows a comparison of the cleaning performance of single and multi-dosing cleaning methods when applied to the cleaning of sebum/pigment stains on cotton.

FIG. 4 shows a comparison of the cleaning performance of single and multi-dosing cleaning methods when applied to the cleaning of sebum/pigment stains on polyester/cotton.

DESCRIPTION OF THE INVENTION

Figure 1:
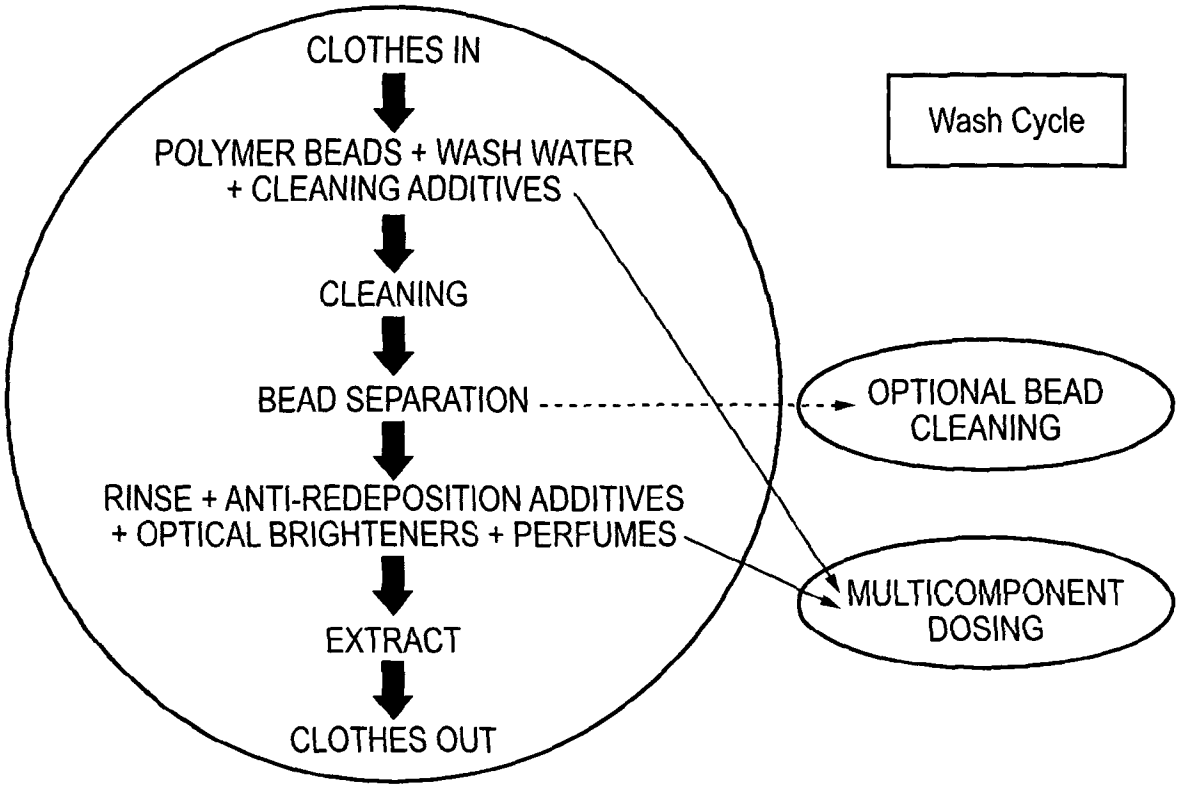
FIG. 1 illustrates a wash cycle carried out using the multi-component dosing approach of the present invention.

In the method according to the first aspect of the invention, the ratio of beads to substrate is generally in the range of from 30:1 to 0.1:1 w/w, preferably in the region of from 10:1 to 1:1 w/w, with particularly favourable results being achieved with a ratio of between 5:1 and 1:1 w/w, and most particularly at around 2:1 w/w. Thus, for example, for the cleaning of 5 g of fabric, 10 g of polymeric particles would be employed.

As previously noted, the method of the invention finds particular application in the cleaning of textile fibres. The conditions employed in such a cleaning system are very much in line with those which apply to the conventional wet cleaning of textile fibres and, as a consequence, are generally determined by the nature of the fabric and the degree of soiling. Thus, typical procedures and conditions are in accordance with those which are well known to those skilled in the art, with fabrics generally being treated according to the method of the invention at, for example, temperatures of between 5 and 95° C. for a duration of between 10 minutes and 1 hour, then being rinsed in water and dried.

The results obtained are very much in line with those observed when carrying out conventional wet cleaning procedures with textile fabrics. The extent of cleaning and stain removal achieved with fabrics treated by the method of the invention is seen to be very good, with particularly outstanding results being achieved in respect of hydrophobic stains and aqueous stains and soiling, which are often difficult to remove. The method also finds application in wash-off procedures applied to textile fibres subsequent to dyeing processes, and in scouring processes which are used in textile processing for the removal of dirt, sweat, machine oils and other contaminants which may be present following processes such as spinning and weaving. No problems are observed with polymer particles adhering to the fibres at the conclusion of the cleaning process, and these particles may subsequently be removed from the washload using, for example, cleaning apparatus as disclosed in PCT Patent Applications Nos. PCT/GB2011/050243, PCT/GB2010/051960 and PCT/GB2010/094959.

Additionally, as previously noted, it has been demonstrated that re-utilisation of the polymer particles is possible, and that particles can be satisfactorily re-used in the cleaning procedure.

As previously discussed, the principal components of the detergent composition comprise cleaning components and post-treatment components. Typically, the cleaning components comprise surfactants, enzymes and oxidising agents or bleaches, whilst the post-treatment components include, for example, anti-redeposition additives, perfumes and optical brighteners.

However, the detergent formulation may optionally include one or more other additives such as, for example, builders, chelating agents, dye transfer inhibiting agents, dispersants, enzyme stabilizers, catalytic materials, bleach or oxidising agent activators, polymeric dispersing agents, clay soil removal agents, suds suppressors, dyes, structure elasticizing agents, fabric softeners, starches, carriers, hydrotropes, processing aids and/or pigments.

Examples of suitable surfactants may be selected from non-ionic and/or anionic and/or cationic surfactants and/or ampholytic and/or zwitterionic and/or semi-polar nonionic surfactants. The surfactant is typically present at a level of from about 0.1%, from about 1%, or even from about 5% by weight of the cleaning compositions to about 99.9%, to about 80%, to about 35%, or even to about 30% by weight of the cleaning compositions.

The compositions may include one or more detergent enzymes which provide cleaning performance and/or fabric care benefits. Examples of suitable enzymes include, but are not limited to, hemicellulases, peroxidases, proteases, other cellulases, other xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof. A typical combination may comprise a mixture of enzymes such as protease, lipase, cutinase and/or cellulase in conjunction with amylase.

Optionally, enzyme stabilisers may also be included amongst the cleaning components. In this regard, enzymes for use in detergents may be stabilised by various techniques, for example by the incorporation of water-soluble sources of calcium and/or magnesium ions in the compositions.

The compositions may include one or more bleach or oxidising compounds and associated activators. Examples of such bleach or oxidising compounds include, but are not limited to, peroxygen compounds, including hydrogen peroxide, inorganic peroxy salts, such as perborate, percarbonate, perphosphate, persilicate, and mono persulphate salts (e.g. sodium perborate tetrahydrate and sodium percarbonate), and organic peroxy acids such as peracetic acid, monoperoxyphthalic acid, diperoxydodecanedioic acid, N,N'-terephthaloyl-di(6-aminoperoxycaproic acid), N,N'-phthaloylaminoperoxycaproic acid and amidoperoxyacid.

Bleach or oxidising activators are well known in the art, and particular examples include compounds which contain perhydrolysable N-acyl or O-acyl residues. Specific examples of these compounds include water-insoluble compounds such as succinic, benzoic and phthalic anhydrides, tetraacetyl-glycoluril (TAGU), and carboxylic acid esters such as N,N,N',N'-tetraacetylethylene diamine (TAED), as well as water-soluble derivatives including acetyl salicylic acid, glucose penta-acetate (GPA), and various esters of phenols and substituted phenols, e.g. sodium acetoxy benzene sulphonate (SABS), sodium benzoyloxy benzene sulphonate (SBOBS) and sodium nonanoyloxybenzene sulphonate (SNOBS).

Suitable builders may be included in the formulations and these include, but are not limited to, the alkali metal, ammonium and alkanolammonium salts of polyphosphates, alkali metal silicates, alkaline earth and alkali metal carbonates, aluminosilicates, polycarboxylate compounds, ether hydroxypolycarboxylates, copolymers of maleic anhydride with ethylene or vinyl methyl ether, 1,3,5-trihydroxybenzene-2,4,6-trisulphonic acid, and carboxymethyl-oxysuccinic acid, various alkali metal, ammonium and substituted ammonium salts of polyacetic acids such as ethylenediamine tetraacetic acid and nitrilotriacetic acid, as well as polycarboxylates such as mellitic acid, succinic acid, oxydisuccinic acid, polymaleic acid, benzene 1,3,5-tricarboxylic acid, carboxymethyloxysuccinic acid, and soluble salts thereof.

The compositions may also optionally contain one or more copper, iron and/or manganese chelating agents and/or one or more dye transfer inhibiting agents.

Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Optionally, the detergent formulations can also contain dispersants. Suitable water-soluble organic materials are the homo- or co-polymeric acids or their salts, in which the polycarboxylic acid may comprise at least two carboxyl radicals separated from each other by not more than two carbon atoms.

Said anti-redeposition additives are physico-chemical in their action and include, for example, materials such as polyethylene glycol, polyacrylates and carboxy methyl cellulose (CMC).

Optionally, the compositions may also contain perfumes Suitable perfumes are generally multi-component organic chemical formulations which can contain alcohols, ketones, aldehydes, esters, ethers and nitrile alkenes, and mixtures thereof. Commercially available compounds offering sufficient substantivity to provide residual fragrance include Galaxolide (1,3,4,6,7,8-hexahydro-4,6,6,7,8,8-hexamethylcyclopenta(g)-2-benzopyran), Lyral (3- and 4-(4-hydroxy-4-methyl-pentyl)cyclohexene-1-carboxaldehyde and Ambroxan ((3aR,5aS,9aS,9bR)-3a,6,6,9a-tetramethyl-2,4,5,5a,7,8,9,9b-octahydro-1H-benzo[e][1]benzofuran). One example of a commercially available fully formulated perfume is Amour Japonais supplied by Symrise® AG.

Suitable optical brighteners fall into several organic chemical classes, of which the most popular are stilbene derivatives, whilst other suitable classes include benzoxazoles, benzimidazoles, 1,3-diphenyl-2-pyrazolines, coumarins, 1,3,5-triazin-2-yls and naphthalimides. Examples of such compounds include, but are not limited to, 4,4'-bis[[6-anilino-4(methylamino)-1,3,5-triazin-2-yl]amino]stilbene-2,2'-disulfonic acid, 4,4'-bis[[6-anilino-4-[(2-hydroxyethyl)methylamino]-1,3,5-triazin-2-yl]amino]stilbene-2,2'-disulphonic acid, disodium salt, 4,4'-Bis[[2-anilino-4-[bis(2-hydroxyethyl) amino]-1,3,5-triazin-6-yl]amino]stilbene-2,2'-disulfonic acid, disodium salt, 4,4'-bis[(4,6-dianilino-1,3,5-triazin-2-yl) amino]stilbene-2,2'-disulphonic acid, disodium salt, 7-diethylamino-4-methylcoumarin, 4,4'-Bis[(2-anilino-4-morpholino-1,3,5-triazin-6-yl)amino]-2,2'-stilbenedisulfonic acid, disodium salt, and 2,5-bis(benzoxazol-2-yl)thiophene.

Referring now to FIG. 1, there is illustrated a wash cycle according to the first aspect of the invention. Thus, clothes are initially loaded into the cleaning chamber of a cleaning apparatus, after which polymeric beads and wash water are added thereto and doses of the cleaning components of the detergent formulation (comprising at least one of surfactants, enzymes and oxidising agents or bleaches) are charged into the apparatus. The cleaning cycle then takes place, following which the beads are removed from the apparatus prior to a rinsing operation in the presence of water and post-treatment components, such as anti-redeposition additives, perfumes and optical brighteners. Extraction of residual chemicals and liquor then takes place, prior to removal of the cleaned clothes from the apparatus. As indicated in FIG. 1, cleaning of the polymeric beads may optionally be performed between clothes cleaning operation.

The bead cleaning process according to the invention, which is carried out typically every 10-12 washes, allows the surface of the beads to remain highly active in the washing process. Preferably, bead cleaning is carried out by adding individual doses of surfactants (non-ionic and/or anionic and/or cationic), and optionally other more aggressive chemicals, selected from, for example, sodium/potassium hydroxide, hypochlorates, hypochlorites or the other oxidising agents or bleaches and activators previously recited, to an amount of water, such that the ratio of water to beads is preferably in the region of 0.5-3 liters water/kg of beads.

The invention will now be further illustrated, though without in any way limiting the scope thereof, by reference to the following example and associated illustrations.

EXAMPLE

Cleaning trials were carried out using a set of trial and control conditions (see Table 1). Thus, the trials involved the use of a preferred cleaning apparatus as described in PCT Patent Application No. PCT/GB2011/050243, performed according to the method of the invention ("Xeros Plus" Multi Dose), whilst the control was carried out in the same apparatus but using a single detergent dose approach wherein the detergent was added at the start of the main wash ("Xeros Plus" Single Dose). The washload in each case was an identical composition of mixed garments totalling 12 kg. The detergent components were

- Surfactant—Mulan 200S supplied by Christeyns;
- Hydrogen Peroxide (the oxidising component)—ACE B supplied by Procter & Gamble;
- Tetraacetylethylenediamine (TAED) (the oxidising component activator)—supplied by Warwick Chemicals;
- Optical Brightener—Leucophor BMB supplied by Clariant; and
- Perfume—Amour Japonais supplied by Symrise® AG.

Stains were added to the washload to stress the detergent—6 off WFK PCMS-55_05-05×05 Standard Industry/Commercial Laundry Stain Monitors, plus 12 off WFK SBL2004 simulated sebum grease stain sheets. The latter were used to generate sebum levels of approximately 8 g/kg of washload, and thereby stress the detergent used.

TABLE 1

CLEANING TRIALS

| Test # | Detergent Dosage (g) | Dosage Timing | Washload (kg) | Detergent Dosage (g/kg) | Wash Temperature (° C.) | Cycle Time (mins) |
|---|---|---|---|---|---|---|
| Xeros Plus Multi Dose | Surfactant 32.9 | At main wash start (Time t = 0) | 12 | 2.74 | 28 | 90 |
| | Hydrogen Peroxide 60.0 (35% aq.) | During main wash (Time t = 10 mins) | | 1.75 | | |
| | TAED 14.3 | During main wash (Time t = 10 mins) | | 1.19 | | |
| | Optical Brightener 1.5 | At final rinse (Time t = 85 mins) | | 0.12 | | |

TABLE 1-continued

| CLEANING TRIALS | | | | | | |
|---|---|---|---|---|---|---|
| Test # | Detergent Dosage (g) | Dosage Timing | Washload (kg) | Detergent Dosage (g/kg) | Wash Temperature (° C.) | Cycle Time (mins) |
| | Perfume 0.7 | At final rinse (Time t = 85 mins) | | 0.06 | | |
| Xeros Plus Single Dose | Surfactant 32.9 | All at main wash start (Time t = 0) | 12 | 2.74 | 28 | 90 |
| | Hydrogen Peroxide 60.0 (35% aq.) | | | 1.75 | | |
| | TAED 14.3 | | | 1.19 | | |
| | Optical Brightener 1.5 | | | 0.12 | | |
| | Perfume 0.7 | | | 0.06 | | |

Both the Xeros Plus Multi Dose and Xeros Plus Single Dose cycles were run at equivalent wash temperatures of 28° C. When using the Xeros Plus Multi Dose cycle, the facility to heat the oxidising component and its activator separately from the main wash in a mixing tank at 60° C. was available, and this approach was utilised in order to allow the component to become more active chemically prior to addition. As previously observed, however, the wash temperature during this cycle only reached 28° C. since, although a small quantity of 60° C. water was added, the ambient temperature of the other wash components kept the overall temperature at the lower level. It should be noted that same amount of 60° C. water was added at the same stage during the wash cycle of the Xeros Plus Single Dose cycle, but without any oxidising component or activator—this having already been added at the start of the main wash, as shown in Table 1. The purpose of this additional heated water in the Xeros Plus Single Dose cycle, therefore, was to ensure an identical temperature profile throughout the washing process to that which applies in the Xeros Plus Multi Dose case, up to the same final wash temperature of 28° C. Hence, the only difference between these two cycles was the means of detergent addition (i.e. multidosing of components throughout the cycle, versus single dosing of all components at the start of the main wash). The overall cycle times of both cycles—including wash, bead separation and rinse—were identical at 90 minutes. A three rinse programme was used for both procedures, with the optical brightener and perfume added in the final rinse for the Xeros Plus Multi Dose cycle, as shown in Table 1.

The level of cleaning was assessed using colour measurement. Reflectance values of the WFK stain monitors were measured using a Datacolor Spectraflash SF600 spectrophotometer interfaced to a personal computer, employing a 10° standard observer, under illuminant $D_{65}$, with the UV component included and specular component excluded; a 3 cm viewing aperture was used. The CIE L* colour co-ordinate was taken for each stain on the stain monitors, and these values were then averaged for each stain type. It should be noted that higher L* values are indicative of better cleaning. The results are set out in Table 2.

TABLE 2

| CLEANING RESULTS | | | | | |
|---|---|---|---|---|---|
| WFK Stain Monitor Coding | Stain Type | Xeros Plus Multi Dose $L^*_{MD}$ | Xeros Plus Single Dose $L^*_{SD}$ | Xeros Plus Multi Dose – Xeros Plus Single Dose ($L^*_{MD} - L^*_{SD}$) | Comments |
| 10C | Pigment/lanolin on cotton | 79.99 | 79.93 | 0.06 | Parity |
| 20C | Pigment/lanolin on polyester/cotton | 76.55 | 75.56 | 0.99 | Multi Dose Superior |
| 90LI | Red wine on cotton, aged (IEC 456) | 86.58 | 85.95 | 0.63 | Multi Dose Superior |
| 10D | Sebum/pigment on cotton | 84.78 | 83.53 | 1.25 | Multi Dose Superior |
| 20D | Sebum/pigment on polyester/cotton | 85.67 | 84.51 | 1.16 | Multi Dose Superior |
| 10U | Curry on cotton | 90.45 | 89.97 | 0.48 | Multi Dose Superior |
| 10M | Motor oil/pigment on cotton | 76.93 | 75.93 | 1.00 | Multi Dose Superior |
| 90RM | Soot/mineral oil on cotton (IEC 456) | 69.48 | 70.98 | −1.50 | Single Dose Superior |

TABLE 2-continued

CLEANING RESULTS

| WFK Stain Monitor Coding | Stain Type | Xeros Plus Multi Dose $L^*_{MD}$ | Xeros Plus Single Dose $L^*_{SD}$ | Xeros Plus Multi Dose – Xeros Plus Single Dose ($L^*_{MD} - L^*_{SD}$) | Comments |
|---|---|---|---|---|---|
| 90PB | Blood on cotton, aged (IEC 456) | 91.54 | 89.12 | 2.42 | Multi Dose Superior |
| 10N | Egg/pigment on cotton | 83.04 | 82.72 | 0.32 | Multi Dose Superior |
| 10R | Starch/pigment on cotton | 73.12 | 74.74 | −1.62 | Single Dose Superior |
| 10PPM | Vegetabl fat/milk/pigment on cotton | 73.07 | 72.45 | 0.62 | Multi Dose Superior |
| 90MF | Cocoa on cotton, aged (IEC 456) | 74.99 | 74.03 | 0.96 | Multi Dose Superior |

As can be seen from Table 2, the Xeros Plus Multi Dose cycle gave overwhelmingly superior cleaning to the Xeros Plus Single Dose cycle. Of the thirteen stain types tested, ten showed superior cleaning with Xeros Plus Multi Dose, in one case parity cleaning was observed with both cycles, whilst only two demonstrated superior cleaning with Xeros Plus Single Dose.

Analysis was then carried out on the stain monitor backing material for background whiteness, and also on the sebum grease removal for stains 10D and 20D (see Table 1) to check the wavelength dependency of these across the visible spectrum (400-700 nm). Grease removal at low wash temperature is a key advantage of cleaning with polymeric beads and, in particular, when combined with this mulitcomponent dosing approach to detergency. Using the same spectrophotometer arrangement described above, reflectance was measured as a function of visible wavelength to determine the colour strength values (K/S), and these are shown in FIGS. 2-4. It was observed that lower K/S values showed better background whiteness and cleaning at any given wavelength.

It becomes evident from FIG. 2 that the background whiteness of the backing material of the stain monitors was improved with the Xeros Plus Multi Dose cycle. This is an effect of the late addition of the optical brightener in the final rinse (see Table 1). Critically here, the K/S values for the 420-480 nm range are improved, thereby giving the material a bluer hue (since this is at the blue end of the visible spectrum) and users typically see this as a considerable performance enhancement. It obviously also indicates that there is scope to reduce the level of optical brightener by using a multi-component dosing approach to detergency, as opposed to a single dose. A visual assessment test was also carried out, with six volunteers assessing this effect. All coding was covered on the test stain monitors to prevent bias, and all six volunteers indicated a superior background whiteness for the backing material of the stain monitors when washed using the Xeros Plus Multi Dose cycle.

The cleaning performance on sebum/pigment (see FIGS. 3 and 4), with the Xeros Plus Multi Dose cycle was again shown to be superior on both the cotton (stain 10D) and polyester/cotton substrates (stain 20D). There is particular interest in this stain as its low temperature removal is a key driver for laundry applications, since it is extremely important, but very difficult, to achieve its successful removal at low wash temperatures, as are experienced according to the present invention. Such performance improvements, therefore, again clearly show the benefits of multi-component dosing for the detergency.

Finally, a sensory test was carried out with the same six volunteers as above to assess the freshness/perfume of the stain monitors used for both cycles. All coding was again covered on the test stain monitors to prevent bias, and four volunteers thought the Xeros Plus Multi Dose cycle had produced a fresher smell on these monitors; a further volunteer was unable to distinguish any difference between the two, whilst the remaining volunteer believed that the Xeros Plus Single Dose cycle had produced a fresher smell. Here too therefore, the evidence was strongly in favour of the multi-component dosing approach for detergency.

Throughout the description and claims of this specification, the words "comprise" and "contain" and variations of them mean "including but not limited to", and they are not intended to (and do not) exclude other moieties, additives, components, integers or steps. Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith. All of the features disclosed in this specification (including any accompanying claims, abstract and drawings), and/or all of the steps of any method or process so disclosed, may be combined in any combination, except combinations where at least some of such features and/or steps are mutually exclusive. The invention is not restricted to the details of any foregoing embodiments. The invention extends to any novel one, or any novel combination, of the features disclosed in this specification (including any accompanying claims, abstract and drawings), or to any novel one, or any novel combination, of the steps of any method or process so disclosed.

The reader's attention is directed to all papers and documents which are filed concurrently with or previous to this specification in connection with this application and which are open to public inspection with this specification, and the contents of all such papers and documents are incorporated herein by reference.

The invention claimed is:

1. A method for cleaning a soiled substrate, said method comprising the treatment of the soiled substrate with a formulation comprising a multiplicity of polymeric particles, wherein said polymeric particles are applied in combination with a detergent formulation, characterised in that said detergent formulation is divided into its separate chemical constituents, wherein the chemical constituents comprise cleaning components and post-treatment components; wherein the post-treatment components comprise at least one component selected from the group consisting of anti-redeposition additives, perfumes, and optical brighteners; and wherein the cleaning components are added before or during the main wash cycle and the post-treatment components are added as a post-treatment following removal of the polymeric particles from the wash process.

2. A method as claimed in claim 1 wherein the cleaning components comprise at least one component selected from surfactants, enzymes, oxidising agents, and bleaches.

3. A method as claimed in claim 2 wherein said oxidising agent or bleach is activated by a chemical activation agent and/or by heating said oxidising agent or bleach separately from the main wash prior to its addition.

4. A method as claimed in claim 1 wherein said detergent formulation additionally comprises at least one component selected from builders, chelating agents, dye transfer inhibiting agents, dispersants, enzyme stabilizers, catalytic materials, oxidising agent or bleach activators, polymeric dispersing agents, clay soil removal agents, suds suppressors, dyes, structure elasticizing agents, fabric softeners, starches, carriers, hydrotropes, processing aids and pigments.

5. A method as claimed in claim 1 wherein chemical constituents comprising enzymes and bleaches and/or oxidising agents are added at different times during the wash cycle.

6. A method as claimed in claim 1 wherein chemical constituents comprising perfumes and bleaches are added at different times during the wash cycle.

7. A method as claimed in claim 1 wherein said substrate comprises a plastics material, leather, paper, cardboard, metal, glass, wood or a textile fibre.

8. A method as claimed in claim 1 wherein said polymeric particles comprise polyalkenes, polyamides, polyesters or polyurethanes.

9. A method as claimed in claim 8 wherein said polymeric particles are linear or crosslinked, foamed or unfoamed, and solid or hollow.

10. A method as claimed in claim 1 wherein water is added so as to achieve a water to substrate ratio which is between 2.5:1 and 0.1:1 w/w.

11. A method as claimed in claim 1 wherein the polymeric particles to substrate has a ratio in the range of from 30:1 to 0.1:1 w/w.

12. A method as claimed in any one of claim 1, 2, 3, or 4-11 wherein the main wash cycle of said method is carried out at a temperature of between 5 and 95° C. for a duration of between 10 minutes and 1 hour.

13. A method as claimed in claim 1 which comprises a batchwise or continuous process.

14. A method as claimed in claim 2 wherein:

said surfactants are selected from non-ionic and/or anionic and/or cationic surfactants and/or ampholytic and/or zwitterionic and/or semi-polar nonionic surfactants;

said enzymes are selected from hemicellulases, peroxidases, proteases, other cellulases, other xylanases, lipases, phospholipases, esterases, cutinases, pectinases, keratanases, reductases, oxidases, phenoloxidases, lipoxygenases, ligninases, pullulanases, tannases, pentosanases, malanases, [beta]-glucanases, arabinosidases, hyaluronidase, chondroitinase, laccase, and amylases, or mixtures thereof; and said oxidising agents or bleaches are selected from peroxygen compounds, wherein said peroxygen compounds are optionally selected from hydrogen peroxide, inorganic peroxy salts, and organic peroxy acids.

15. A method as claimed in claim 1 wherein:

said anti-redeposition additives are selected from polyethylene glycol, polyacrylates and carboxy methyl cellulose;

said perfume optionally comprises at least one of alcohols, ketones, aldehydes, esters, ethers and nitrile alkenes, and mixtures thereof; and said optical brighteners are selected from stilbene derivatives, benzoxazoles, benzimidazoles, 1,3-diphenyl-2-pyrazolines, coumarins, 1,3,5-triazin-2-yls and naphthalimides.

16. The method as claimed in claim 8, wherein said polyamide particles comprise beads of Nylon 6 or Nylon 6,6 and said polyester particles comprise beads of polyethylene terephthalate or polybutylene terephthalate.

* * * * *